US005542270A

United States Patent [19]

Mista et al.

[11] Patent Number: 5,542,270

[45] Date of Patent: Aug. 6, 1996

[54] GUIDE BAR ARRANGMENT FOR WARP KNITTING MACHINE HAVING BENDING TRANDUCERS

[75] Inventors: Kresimir Mista, Heusenstamm; Hans-Jurgen Hohne, Hainburg, both of Germany

[73] Assignee: Karl Mayer Textilmachinenfabrik GmbH, Obertshausen, Germany

[21] Appl. No.: 538,410

[22] Filed: Oct. 2, 1995

[30] Foreign Application Priority Data

Oct. 5, 1994 [DE] Germany ..... 44 35 562.9

[51] Int. Cl.[6] ..... D04B 27/26; D04B 27/24; D04B 27/32; D04B 3/02

[52] U.S. Cl. ..... 66/207; 66/203

[58] Field of Search ..... 66/203, 204, 205, 66/207

[56] References Cited

U.S. PATENT DOCUMENTS

| | | | |
|---|---|---|---|
| 4,416,205 | 11/1983 | Schwartz | 66/207 X |
| 4,614,095 | 9/1986 | Porat | 66/207 |
| 5,390,512 | 2/1995 | Mista | 66/205 |
| 5,473,913 | 12/1995 | Bogucki-land | 66/207 |

FOREIGN PATENT DOCUMENTS

| | | | |
|---|---|---|---|
| 415009 | 6/1962 | Germany . | |
| 936948 | 5/1963 | Germany . | |
| 2349931 | 9/1974 | Germany | 66/204 |
| 2950663 | 7/1980 | Germany . | |
| 286826 | 2/1991 | Germany | 66/204 |
| 4019111 | 12/1991 | Germany | 66/207 |
| 3092762 | 4/1988 | Japan | 66/207 |

*Primary Examiner*—John J. Calvert
*Attorney, Agent, or Firm*—Omri M. Behr, Esq

[57] ABSTRACT

A guide bar arrangement for a warp knitting machine has at least one guide bar, which is axially displaceable by means of a displacing arrangement and is carried, suitably on an axially rigid holding arrangement attached to a swinging shaft, through the intermediation of a compensating arrangement. The compensating arrangement and the displacement arrangement include bending transducers, which are attached at one end thereof on the holding arrangement (a lever 19 holding rails) and on the other end thereof on the guide bar and are bendably deformed under the influence of a direct current control signal. This leads to a simple construction of the guide bar arrangement with little frictional loss.

24 Claims, 3 Drawing Sheets

GUIDE BAR ARRANGMENT FOR WARP KNITTING MACHINE HAVING BENDING TRANDUCERS

FIELD OF THE INVENTION

The invention is directed to a guide bar arrangement for a warp knitting machine wherein the guide bar is axially displaceable by a displacement arrangement and is held by an axially non-displaceable holding means suitably attached to the swinging shaft via an intermediately placed compensating arrangement.

BACKGROUND OF RELATED ART

In a known guide bar arrangement of this type, DE GM 185 710 0, the displacement arrangement comprises a pusher rod controlled by a cam plate against which the guide bar is held by means of a return spring. The smoothing arrangement, which enables the displacement of the guide bar with respect to levers attached to the swinging beam, is provided by a plurality of guide bolts which are held in axial bearings provided in roller bearing boxes.

In order to drive the warp knitting machine at greater speeds, the guiding by the axial bearings must be substantially free of play. This leads to a larger amount of friction and a corresponding consumption of energy, which is converted into heat and thus to an undesired expansion of the guide bar. The high frictional forces also considerably bias the transfer elements of the displacement arrangement and also cause friction. At high working speeds, larger acceleration and deceleration forces also come into play.

An object of the present invention is to provide a guide bar arrangement of the foregoing type having a substantially simpler construction and only negligible frictional losses.

SUMMARY OF THE PRESENT INVENTION

In accordance with the illustrative embodiments demonstrating features and advantages of the present invention, there is provided, a guide bar arrangement for a warp knitting machine having a swinging shaft. This arrangement includes a guide bar and a displacing arrangement for axially displacing the guide bar. Also included is a holding means having an intermediating compensating arrangement for supporting the guide bar. The holding means is axially fixed and attached to the swinging shaft. The compensating arrangement and the displacement arrangement include a plurality of bending transducers, each having one end attached to the holding means and another end attached to the guide bar. The bending transducers are deflectable under the influence of an electrical control signal.

An improved smoothing arrangement and displacing arrangement can thereby be formed with bending transducers which are attached at one end thereof in the holding means and the other end thereof carrying the guide bar and are deformed under the influence of a control signal. In such an arrangement, it is no longer necessary to utilize the various elements of the displacement arrangement (for example pattern cam disk, pattern chain, setting motor and the like). Also unnecessary are all of the axial bearings of the smoothing arrangement. Rather all of the functions of the displacement arrangement and the compensating arrangement may be taken over by the bending transducers.

The number of required bending transducers is determined by the machine production level or the expected requirements of servicing. Even with two bending transducers, a parallelogram is formed together with the holding means and the guide bar in such a manner that even with deformation of the bending transducers, the guide bar is still held parallel to the holding means.

The change in height of the guide bar during the conventionally occurring displacement arrangement is so small that for practical purposes, it can be ignored. In practice however, a larger number of bending transducers are utilized, on the one hand to give the guide bar a higher stability despite axial movement and on the other hand to provide the bending deformation with a sufficient displacing force.

It should be noted that the displacing force is held to be substantially less than was utilized heretofore since it is unnecessary to utilize a return spring in order to achieve a force transferring contact between the displacing arrangement and the guide bar. Furthermore, it should be noted that the additional mass on the guide bar due to the bending transducers is substantially less than the additional mass thereto provided by the axial bearings so that a higher rate of working speed may be obtained.

It is particularly advantageous if the holding means on the lever attached to the swinging shaft comprises a holding rail and that the bending transducers are distributed over the entire length of the guide bar. By utilizing a holding rail, the bending transducer groups may be located at a comparatively small distance from each other so that the holding points of the guide bar are comparatively close. This permits the guide bar to have a smaller cross-section and thus to be provided with a lower mass which again leads to a higher working speed.

It is further advantageous to provide the bending transducers in mutually attached groups which are provided with a common header for fastening onto the holding means and a common footing for fastening onto the guide bar. In this manner, it is possible to insert and remove groups of bending transducers, which is very useful for assembly and repair.

Suitably, the bending transducers are piezoelectric transducers which have an active layer of piezoelectric material in strips either on one side or on both sides. Such bending transducers may be readily activated by a control potential and react very readily to such control potentials. It is thus possible to operate with conventional high working speeds and even achieve yet higher working speeds. However, the invention may include the use of other bending transducers, for example, electromagnetic or magnetostrictive or otherwise activated transducers.

It is preferred to provide the strip-shaped carrier with a protrusion at its foot end extending beyond the active layer. This non-activatable layer increases displacement of the guide bar so that the displacement path of several millimeters may be achieved.

It is advantageous to make the strip carriers of a carbon fiber composite, that is, a polymer filled with carbon fibers. This yields a particularly light, but stable construction to the bending transducer.

It is particularly advantageous if the provision of the control current causes the bending transducers to move from a neutral position either to the left or the right, as desired. Thus, if there is applied a positive control potential and another time a similar negative control potential to the bending transducer, there are provided three equidistant positions of the guide bar so that, for example, a tricot base fabric can be knitted. By utilization of different potentials, it is also possible to provide different displacement movements.

In a preferred embodiment, the strip formed carriers are made out of an electrically isolating material and on both sides are provided with a coating comprising an inner electrode, an active layer and an outer electrode, wherein the inner electrode is connected to the power source and the outer electrode to ground. Such a bending transformer has the further advantage that it may be safely touched since the outermost electrodes are grounded.

It is also advantageous to provide a displacement control arrangement, which provides the control current to the bending transducers in predetermined size as well as in accordance with the predetermined program. In this manner, the displacement arrangement can be so carried through that no excessive acceleration or deceleration occurs. Further details may be found in Applicants' copending application DE P 44 11 528.8 (corresponding to U.S. Ser. No. 08/412,167) which is incorporated herein by reference.

It is furthermore advantageous to provide stops to limit the displacement path of the guide bar. It is possible to achieve displacement targets very rapidly, however it is still advantageous to provide definite end points. Furthermore, these stops can be moved by a drive means such as a setting motor. It is thus possible to drive the guide with very different displacement steps.

In a further embodiment of the invention, the guides themselves may be displaceable by piezoelectric deflecting transducers carried by the guide bars and individually influenceable by control potentials. In this manner, guide bar may be both displaceable by bending transducers and equally acts as a jacquard controlled guide bar because of deflecting transducers.

BRIEF DESCRIPTION OF THE DRAWINGS

The invention may be further illustrated in its preferred embodiments by the following figures.

DETAILED DESCRIPTION OF PREFERRED EMBODIMENTS

Figure 1:
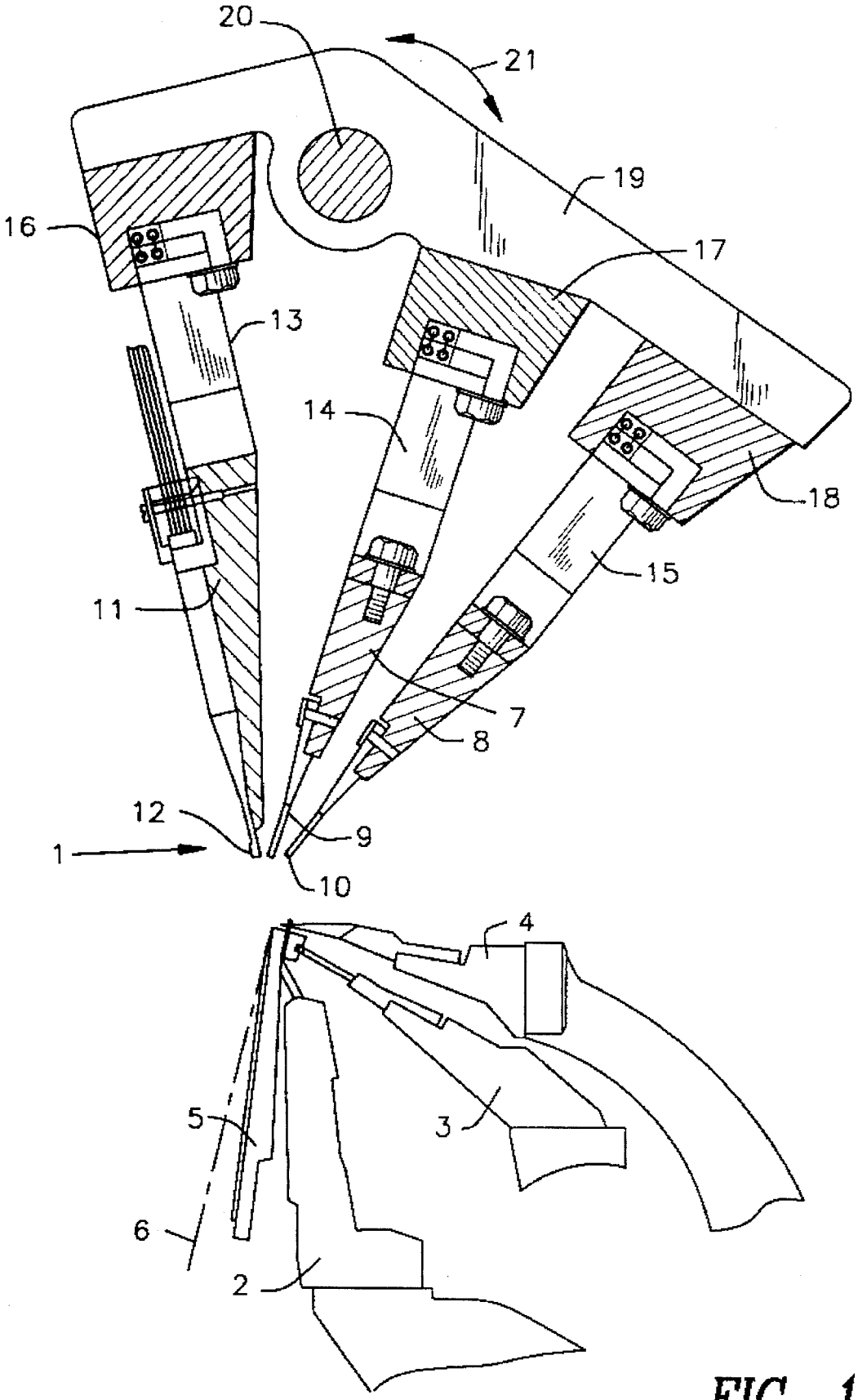
FIG. 1 is a vertical cross-sectional view through the working region of a warp knitting machine provided with the guide bar arrangement of the present invention.

FIG. 1 shows the working area (1) of a warp knitting machine having a needle bar (2) carrying needles together with the appropriate sliders on slider bar (3), a stitch comb bar (4) and a knock-over bar (5) over whose upper edge finished fabric (6) may be pulled. Two guide bars (7 & 8) with guides (9 & 10), respectively form the fabric ground. A guide bar (11) having jacquard control guides (12) provides the patterning.

The several guide bars have interposed bending transducers (13, 14 and 15) that are held by a holding means, shown herein as holding rails (16, 17 and 18) and swing lever (19). These latter are held fast on swinging shaft (20) and may be moved to and fro in the direction of arrow (21) wherein the-guides (9, 10 and 12) may be moved from the illustrated overlap situation into the underlap position and back again.

Under the term "bending transducers," there are included in the first instance elements made out of a bendable material which, under the influence of an outside force, suitably electrical or mechanical is deformed through bending. For the presently required purpose, these elements are preferably in strip form.

Figure 3:
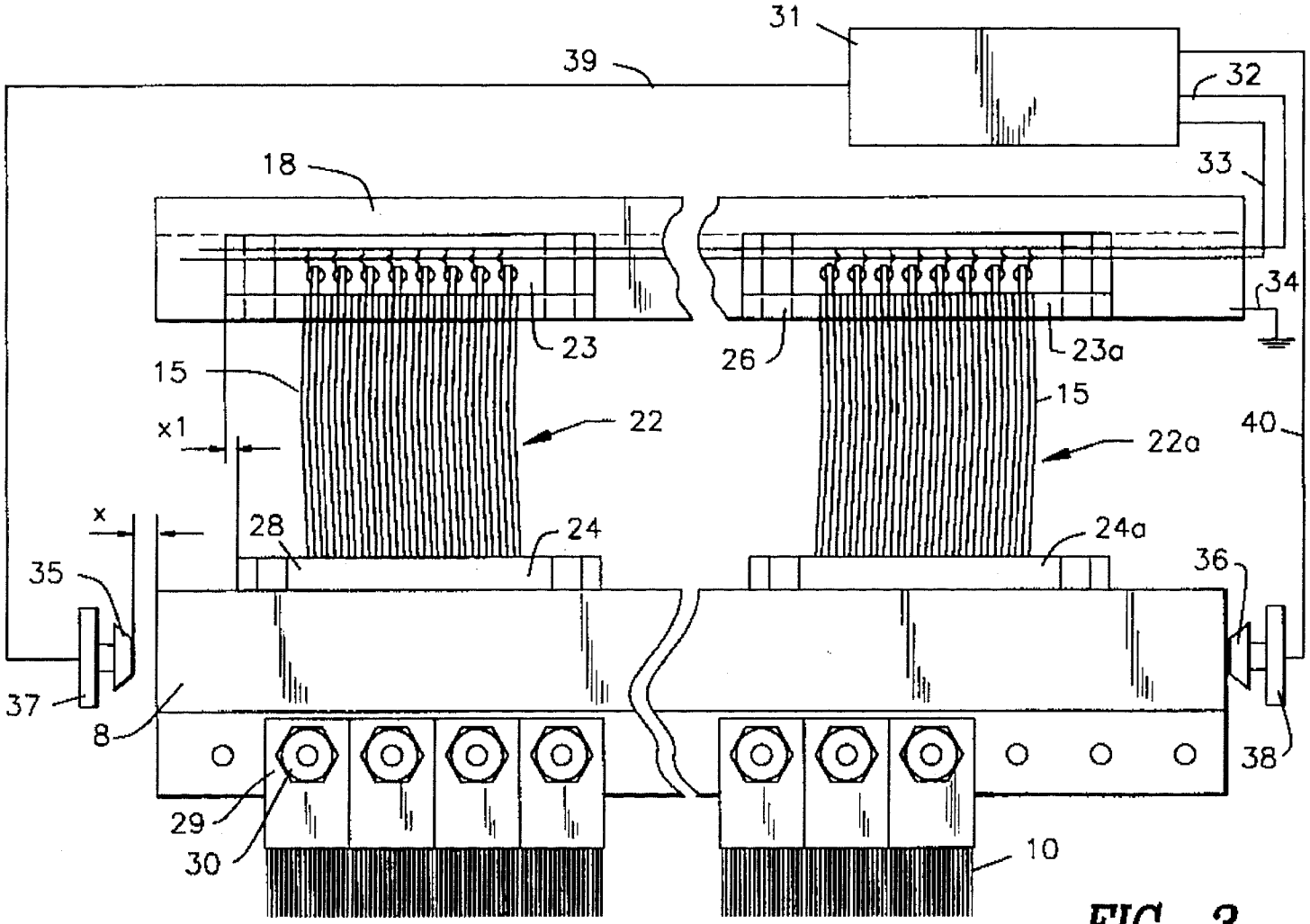
FIG. 3 is a vertical front view of the guide bar arrangement of FIG. 2.
Figure 2:
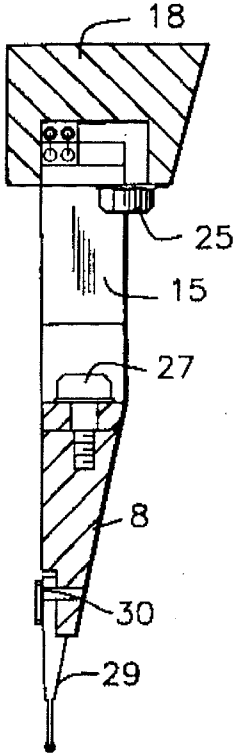
FIG. 2 is a vertical cross-sectional view of one of the two right-hand guide bar arrangement of FIG. 1.

Referring to FIGS. 2 and 3, holding rail (18) stretches over the entire length of right-hand guide bar (8). Eight piezoelectric bending transducers (15) are put together in groups (22 and 22*a*), which have a header (23 and 23*a*) and a footing (24 and 24*a*), respectively. The piezoelectric bending transducers (15) are connected with the header (23) and the footing (24). Screws (25) which grasp through holes (26) serve to attach the header (23) to the holding rail (18). Screws (27) grip through holes (28) and serve to affix the footing (24) to the guide bar (8). The latter generally carry leads (29), which are attached by means of screws (30) and themselves carry a plurality of guides (10).

Figure 5:
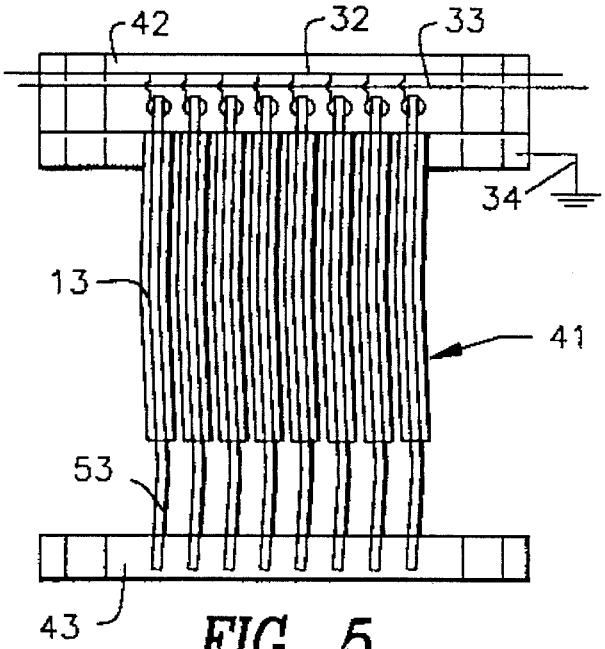
FIG. 5 is a group bending transducers set up for assembly in the machine of FIG. 1.
Figure 6:
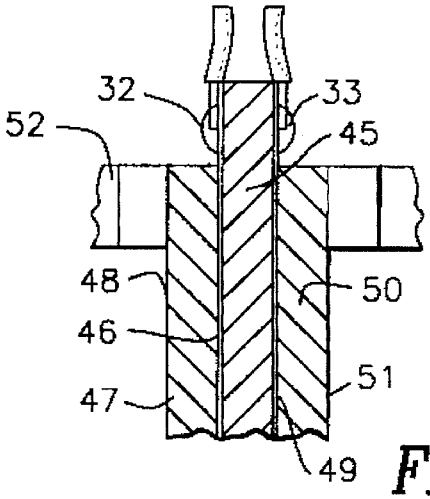
FIG. 6 is the upper mounting location of a bending transducer of FIG. 5.

Two signal leads (32 and 33) are attached to control arrangement (31) over which the electrical potential of a control signal may be led to the depending transducers (15) as is further illustrated in FIGS. 5 and 6. The holding rail (18) is grounded at (34). By providing the control potential, the lower ends of the bending transducers (15) are displaced in one or the other direction so that the guide bar (8) can provide a displacement (X1).

Stops (35 and 36) serve to limit the extent of travel of the displacement movement and thus provide an exact setting for guides (10) during their swing through the needle gaps between the needles.

In FIG. 3, a composite displacement (X) is illustrated. The stops (35 and 36) can be further displaced by the setting motors (drive means 37 and 38) receiving signals through leads (39 and 40) connected to the control arrangement (31)

.

Figure 4:
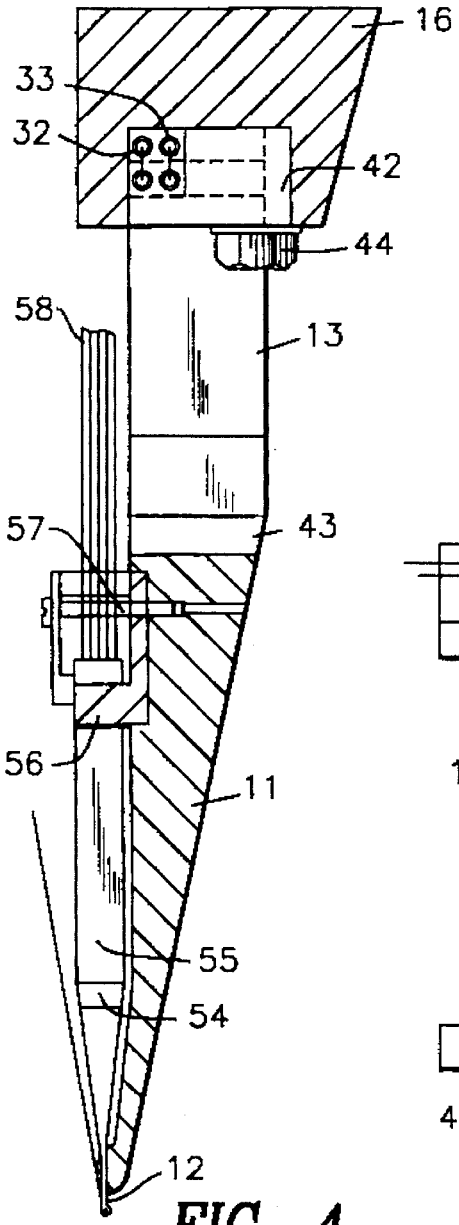
FIG. 4 is a cross-sectional view of the left-hand guide bar arrangement of FIG. 1.

FIGS. 4 and 5 show the left-hand guide bar arrangement of FIG. 1 with guide bar (11) and holding rail (16) . Furthermore, groups (41) of bending transducers (13) are connected at their upper end with header (42) and at their lower end with footing (43) which, similarly to what is shown in FIGS. 2 and 3, are connected with holding rail (16) by means of screws, for example screws (44).

The bending transducer (13) comprises, as shown in FIG. 6 a strip-formed carrier (45) of electrically insulating material, for example, reinforced glass fibers. On one side of carrier (45) there is a layer comprising: inner electrode (46), the piezoelectrically activated layer (47), and outer electrode (48). On the other side of carrier (45) is a layer comprising: inner electrode (49), piezoelectrically active layer (50), and outer electrode (51).

The two inner electrodes (46 and 49) are connected with signal leads (32 and 43). The two outer electrodes (48 and 51) are grounded via the potential of the mass of the machine, whereby the header (42) and the holding rail (16) and are grounded. For this purpose the header (42) is provided with comb-like grooves (52) in which the upper end of the bending transducers (13) can be slid and there clamped or affixed by other means. The strip-formed carrier (45) possesses a protrusion (53) extending beyond the active layers (47) and (50) and whose lower end is set in a slit in footing (43).

Commencing at a neutral position of bending transducer (13), upon the application of a control potential to the inner electrode (46), the footing (43) moves to the left and by the provision of a control potential to the right inner electrode (49) it moves to the right. The displacement distance is substantially proportional to the loading on the bending transducer and thus is proportional to the applied DC voltage potential. By successive applications of equal potentials, displacements of equal size will occur, which without any difficulty may be set to be equal to one or a plurality of the spacings between the needles. In this manner, it is possible to control the displacement in a pattern conforming manner.

Figure 7:
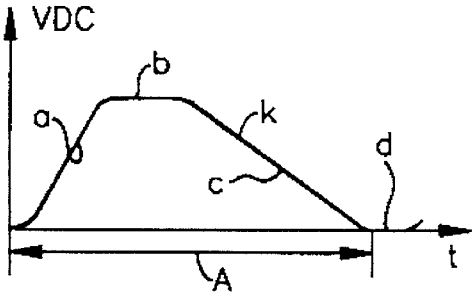
FIG. 7 is a graph showing applied potential of the control signal of FIG. 1 against time.

Furthermore, as is shown in FIG. 7, in the course of a work cycle A, the control potential in volts DC follows a curve (k) in which: segment (a) corresponds to the overlap displacement; segment (b) follows the swing-through into the underlap position; segment (c) shows the underlap displacement itself; and segment (d) shows the swing back of the guide bar (11) into the overlap position. The individual segments may run in straight lines, however in between them advantageously, there are transition steps. In this way at the beginning one seeks a modification of the acceleration of guide bar (11) and modification of the deceleration at the end of the cycle. There are here no excessive counter forces so that there is provided a trouble free mode of proceeding.

The guides (12) are attached to carrier strips (54) on piezoelectric deflecting transducers (55), which in turn are affixed to header (56). This is attached to guide bar (11) by means of screws (57). Electrical leads (58) are connected to control arrangement (31). In this way guides (12) may be displaced in the manner of a jacquard control. With respect to further specific questions of such jacquard control with piezoelectric bending transducers, reference is made to Applicant's prior German patent applications, namely P 42 26 899 (U.S. Ser. No. 08/1 04,369); P 43 16 396, P 44 14 876 (U.S. Ser. No. 08/426,887), and P 44 18 714 (U.S. Ser. No. 08/412,167), whose disclosure is incorporated herein by reference. The construction of the piezoelectric bending transducers described in the foregoing applications may be similarly utilized for bending transducers (13 through 15) of the present application.

This structure may also apply as well to the provision of a second bending transducer in the region of the extension (43 of FIG. 1) which can bend in a direction opposite to that of the first bending transducer. By means of the second bending transducer, the lower end of the strip-formed carrier is displaced parallel to itself during the bending formation. The loading of the carrier on the attachment point on the guide bar side is therefore minimal.

Figure 8:
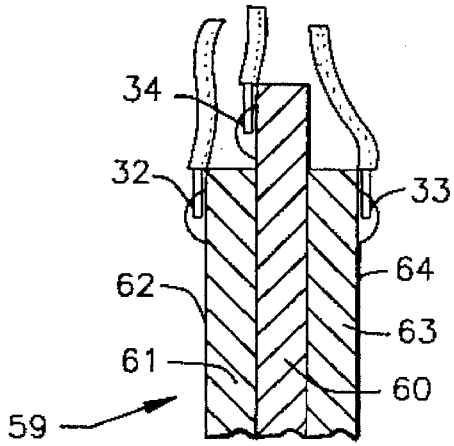
FIG. 8 is a partial sectional view of a bending transducer that is an alternate to that of FIG. 6.

FIG. 8 illustrates the upper end of the bending transducer (59). A strip-formed carrier (60) is made of a synthetic material strengthened with carbon fibers, which makes it electrically conductive. On one side, it carries a layer of piezoelectrically active material (61) having an outer electrode (62) and on the other side there is coated a piezoelectrically active layer (63) having an outer electrode (64). The outer electrode (62) is connected with signal line (32) and the outer electrode (64) with signal line (33). The electrically conductive carrier (60) is grounded at point (34). Such a bending transducer can be very light in weight, and still be made with very high stability.

It is to be appreciated that various modifications may be implemented with respect to the above described preferred embodiments. For example, in many cases it is sufficient if the holding means comprises the swinging lever (19). The holding rails (16, 17 and 18) may no longer be required.

Obviously, many other modifications and variations of the present invention are possible in light of the above teachings. It is therefore to be understood that within the scope of the appended claims, the invention may be practiced otherwise than as specifically described.

We claim:

1. A guide bar arrangement for a warp knitting machine having a swinging shaft and comprising:

a guide bar;

a displacing arrangement for axially displacing said guide bar; and a holding means having an intermediating compensating arrangement for supporting said guide bar, said holding means being axially fixed and attached to the swinging shaft, said compensating arrangement and said displacement arrangement including:

a plurality of bending transducers, each having one end attached to the holding means and another end attached to the guide bar, said bending transducers being deflectable under the influence of an electrical control signal.

2. A guide bar arrangement in accordance with claim 1 wherein the holding means comprises:

at least one lever attached to the swinging shaft; and a holding rail attached to said lever, the bending transducers being substantially distributed coextensively with the guide bar.

3. A guide bar arrangement in accordance with claim 2 wherein the bending transducers are divided into groups, each of the groups having a common header for fastening the bending transducers onto the holding means and a common footing for fastening the bending transducers to the guide bar.

4. A guide bar arrangement in accordance with claim 1 wherein the bending transducers each comprise:

a carrier having two sides; and at least one strip-shaped, piezoelectric, active layer overlaying at least one of the sides of the carrier.

5. A guide bar arrangement in accordance with claim 2 wherein the bending transducers each comprise:

a carrier having two sides; and at least one strip-shaped, piezoelectric, active layer overlaying at least one of the sides of the carrier.

6. A guide bar arrangement in accordance with claim 4, wherein the carrier extends beyond the active layer.

7. A guide bar arrangement in accordance with claim 6, wherein the carrier comprises a carbon fiber composite.

8. A guide bar arrangement in accordance with claim 4 wherein the carrier comprises a carbon fiber composite.

9. A guide bar arrangement in accordance with claim 8, wherein each of the bending transducers are operable by application of the control signal to be selectively moved either left or right.

10. A guide bar arrangement in accordance with claim 4, wherein each of the bending transducers are operable by application of the control signal to be selectively moved either left or right.

11. A guide bar arrangement in accordance with claim 1, wherein each of the bending transducers are operable by application of the control signal to be selectively moved either left or right.

12. A guide bar arrangement according to claim 4 wherein the carrier comprises:

an electrically isolating material; and a pair of layers on opposite sides of said isolating material, each layer having (a) an inner electrode adapted to receive said control signal, (b) an active layer, and (c) a outer electrode held at a reference potential.

13. A guide bar arrangement according to claim 6 wherein the carrier comprises:

an electrically isolating material; and a pair of layers on opposite sides of said isolating material, each layer having (a) an inner electrode adapted to receive said control signal, (b) an active layer, and (c) a outer electrode held at a reference potential.

14. A guide bar arrangement in accordance with claim 1, comprising:

a displacement control arrangement for adjusting potential of said control signal in a pre-programmed sequence.

15. A guide bar arrangement in accordance with claim 4, comprising:

a displacement control arrangement for adjusting potential of said control signal in a pre-programmed sequence.

16. A guide bar arrangement in accordance with claim 7 comprising:

a displacement control arrangement for adjusting potential of said control signal in a pre-programmed sequence.

17. A guide bar arrangement in accordance with claim 14 comprising:

at least one stop for limiting the displacement movement of the guide bar.

18. A guide bar arrangement in accordance with claim 7, comprising:

at least one stop for limiting the displacement movement of the guide bar.

19. A guide bar arrangement in accordance with claim 4, comprising:

at least one stop for limiting the displacement movement of the guide bar.

20. A guide bar arrangement in accordance with claim 1, comprising:

at least one stop for limiting the displacement movement of the guide bar.

21. A guide bar arrangement in accordance with claim 20 comprising:

a drive means for displacing the at least one stops.

22. A guide bar arrangement in accordance with claim 1, wherein the guide bar comprises:

a plurality of guides;

a plurality of piezoelectric deflecting transducers interposed between the guide bar and the guides, said deflecting transducers being individually displaceable under the influence of control potentials.

23. A guide bar arrangement in accordance with claim 4, wherein the guide bar comprises:

a plurality of guides;

a plurality of piezoelectric deflecting transducers interposed between the guide bar and the guides, said deflecting transducers being individually displaceable under the influence of control potentials.

24. A guide bar arrangement in accordance with claim 14 wherein the guide bar comprises:

a plurality of guides;

a plurality of piezoelectric deflecting transducers interposed between the guide bar and the guides, said deflecting transducers being individually displaceable under the influence of control potentials.

* * * * *